US012630974B2

(12) United States Patent
Ku et al.

(10) Patent No.: US 12,630,974 B2
(45) Date of Patent: May 19, 2026

(54) CONTINUOUS STRANDING SYSTEM

(71) Applicant: Rio M&C Co., Ltd., Boeun-eup (KR)

(72) Inventors: Mi Song Ku, Gunpo-si (KR); Cheol Min Kim, Anyang-si (KR)

(73) Assignee: Rio M&C Co., Ltd., Boeun-eup (KR)

( * ) Notice: Subject to any disclaimer, the term of this patent is extended or adjusted under 35 U.S.C. 154(b) by 0 days.

(21) Appl. No.: 18/907,372

(22) Filed: Oct. 4, 2024

(65) Prior Publication Data

US 2025/0116063 A1 Apr. 10, 2025

(30) Foreign Application Priority Data

Oct. 5, 2023 (KR) ..... 10-2023-0132372

(51) Int. Cl.
*D07B 7/02* (2006.01)

(52) U.S. Cl.
CPC ..... *D07B 7/02* (2013.01); *D07B 2207/4004* (2013.01); *D07B 2207/4018* (2013.01)

(58) Field of Classification Search
CPC . D07B 7/02; D07B 7/10; D07B 7/021; D07B 2207/4004; D07B 2207/4018; D07B 2207/40; D07B 3/04
See application file for complete search history.

(56) References Cited

U.S. PATENT DOCUMENTS 3,396,522 A * 8/1968 Biagini ..... D07B 3/06 57/15
4,009,561 A * 3/1977 Young ..... D07B 3/00 57/15

(Continued)

FOREIGN PATENT DOCUMENTS

JP 2001-55678 A 2/2001
JP 2016-106186 A 6/2016
KR 10-2114395 B1 5/2020
KR 102114395 * 5/2020 ..... D07B 3/00

OTHER PUBLICATIONS

Machine translation KR102114395 (Year: 2020).*

(Continued)

*Primary Examiner* — Uyen T Nguyen

(74) *Attorney, Agent, or Firm* — Bradley Arant Boult Cummings LLP; Henry B. Ward, III

(57) ABSTRACT

A continuous stranding system is disclosed. According to an aspect of the present disclosure, a continuous stranding system including: a plurality of stranders configured to receive a center wire and a plurality of peripheral wires provided from outside to manufacture and discharge a strand in a shape of the plurality of peripheral wires stranded to a single layer around the center wire; and a winding spool configured to wind the manufactured strand into a shape of the peripheral wires stranded to multiple layers around the center wire by sequentially through the plurality of stranders may be provided. A first disposed strander among the plurality of stranders is configured to receive a wire from a supply spool of a plurality of wires as the center wire and the plurality of peripheral wires and other stranders among the plurality of stranders are configured to receive a strand discharged from a preceding strander as a center wire and a wire from the supply spool of a plurality of wires as a plurality of peripheral wires.

9 Claims, 6 Drawing Sheets

(56) References Cited

U.S. PATENT DOCUMENTS

| | | | | | |
|---|---|---|---|---|---|
| 4,266,399 | A * | 5/1981 | Ellis, Jr. | H01B 13/04 | 57/293 |
| 4,601,165 | A * | 7/1986 | Weidenhaupt | D07B 7/025 | 57/902 |
| 4,785,617 | A * | 11/1988 | Bourgois | D07B 3/00 | 57/58.52 |
| 4,903,473 | A * | 2/1990 | Classen | D07B 7/02 | 57/58.34 |
| 2012/0298403 | A1 * | 11/2012 | Johnson | H01B 5/105 | 174/130 |

OTHER PUBLICATIONS

Notice of Submission of Opinion issued by the Korean Intellectual Property Office in corresponding Korean Patent Application No. 10-2023-0132372 on Jan. 31, 2025, 12 pages including English translation.

* cited by examiner

CONTINUOUS STRANDING SYSTEM

CROSS-REFERENCE TO RELATED APPLICATION

The present application claims priority from Korean Patent Application No. 10-2023-0132372, filed on Oct. 5, 2023, in the Korean Intellectual Property Office, the disclosure of which is incorporated herein in its entirety by reference.

BACKGROUND

1. Field

The present disclosure relates to a continuous stranding system. More particularly, the present disclosure relates to a continuous stranding system configured to continuously implement a first stranding and a second stranding with a first stranded wire as a center wire.

2. Description of Related Art

A strand is manufactured by twisting a plurality of element wires. When a plurality of strands is twisted once again, it is referred as a wire rope. A wire rope is a product that is being used in various industrial fields for transferring power or supporting a load, for example, in a ship, a machine, a plane, a crane, an elevator, a cable car or a bridge.

Meanwhile, a strand may be manufactured by twisting multiple layers, not a single layer, of element wires on a central wire.

However, a conventional strander is configured to strand a wire only to a single layer on a central wire.

Accordingly, the only method of manufacturing a strand stranded to multiple layers of wires was to proceed with a first stranding with a strander and a second stranding after moving and installing a winding spool wound with the first stranded wire on another strander. That is, the first stranding and the second stranding are not continuously implemented, and the manufacture efficiency is low due to separation in time and space.

SUMMARY

An embodiment of the present disclosure provides a continuous stranding system consisted of a plurality of stranders and configured to continuously implement a first stranding and a second stranding with the first stranded wire as a center wire.

According to an aspect of the present disclosure, the continuous stranding system includes a plurality of stranders configured to receive a center wire and a plurality of peripheral wires provided from outside to manufacture and discharge a strand in a shape of the plurality of peripheral wires stranded to a single layer around the center wire; and a winding spool configured to wind the manufactured strand into a shape of a plurality of peripheral wires stranded to multiple layers around the center wire by sequentially through the plurality of stranders. A first disposed strander among the plurality of stranders is configured to receive a wire from a supply spool of a plurality of wires as the center wire and the plurality of peripheral wires. Other stranders among the plurality of stranders are configured to receive a strand discharged from a preceding strander as a center wire and a wire from the supply spool of a plurality of wires as a plurality of peripheral wires.

The continuous stranding system may further include a tension control device respectively interposed between the stranders of the plurality of stranders.

The strander includes a stranding unit configured to strand the center wire and the plurality of peripheral wires provided from outside by rotation; and a capstan unit configured to pull the strand stranded by and discharged from the stranding unit so that the center wire and the plurality of peripheral wires provided from outside pass through the stranding unit. The capstan unit includes a capstan drum coupled to a first rotational shaft rotatable by a first motor and configured to wind a strand; an unwinding drum detachably disposed from the capstan drum in a length direction of the first rotational shaft; and a turn drum interposed between the capstan drum and the unwinding drum and provided with a first guide roller configured to guide the strand, which is wound and unwound from the capstan drum, to be wound on the unwinding drum in an opposite direction to the winding direction of the capstan drum. The strand wound on the unwinding drum may be unwound from the unwinding drum and discharged to a subsequent strander or the winding spool by a rotational force of a capstan drum of the subsequent strander subsequently disposed to the corresponding strander or the winding spool.

The strander may further include a base frame for mounting the stranding unit and the capstan unit.

The unwinding drum may be coupled to a second rotational shaft configured to rotate in an opposite direction of the first rotational shaft by a second motor to unwind the strand wound on the capstan drum and then wind.

The turn drum may be supported to freely rotate in either direction by a bearing interposed between the turn drum and the first rotational shaft or the second rotational shaft.

The second rotational shaft may have a hollow cylindrical shape so that the first rotational shaft is disposed to penetrate the second rotational shaft in a length direction of the second rotational shaft.

The stranding unit may include a rotator including a third rotational shaft rotatable by a third motor, a first arm extended from an end of the third rotational shaft in a radius direction and a second arm horizontally extended from an end of the first arm on a perimeter surface of the capstan drum and provided with a first penetrating hole at another end of the third rotational shaft; a poise coupled to the another end of the third rotational shaft and configured to strand the center wire and the plurality of peripheral wires provided from outside to a strand by rotation of the rotator and discharge the strand through the first penetrating hole; and a plurality of second guide rollers rotatably coupled to the rotator and configured to guide the strand discharged through the first penetrating hole to be wound on the capstan drum.

The third rotational shaft may extend in a length direction of the first rotational shaft.

An outlet of the first penetrating hole is formed on a perimeter surface of the third rotational shaft that is not an end. The plurality of the second guide rollers may include a 2-1 guide roller rotatably coupled to the third rotational shaft and configured to guide the strand to be discharged through the outlet; a 2-2 guide roller rotatably coupled to an end of the second arm and configured to guide a strand to the capstan drum; and a 2-3 guide roller rotatably coupled to the second arm and configured to guide a strand from the 2-1 guide roller to the 2-2 guide roller sequentially through a second penetrating hole formed on the first arm and a third penetrating hole formed on the second arm.

According to an embodiment of the present disclosure, a strand first stranded from a strander first disposed among the plurality of stranders is provided to a subsequent strander so that a second stranding is continuously implemented around thereof as a center wire, thereby manufacturing a strand with several layers of wires stranded around the center wire.

In addition, when there is a need for differently controlling an input speed and an output speed of a wire, each strander may be configured to be controlled accordingly.

For example, it may be needed to differently control an input speed or an output speed of a wire in a preceding strander when an input speed or a tension of a wire required for stranding in a preceding strander is different from an input speed or a tension of a wire required for stranding in a subsequent strander or even when a wire supply spool or a winding spool needs to be replaced.

BRIEF DESCRIPTION OF THE DRAWINGS

These and/or other features will become apparent and more readily appreciated from the following description of the embodiments, taken in conjunction with the accompanying drawings in which.

DETAILED DESCRIPTION

Hereinafter, certain preferred embodiments of the present disclosure will be described with reference to the accompanied drawings.

Unless otherwise defined, the terms used in the embodiments of the present disclosure may be interpreted to mean the general understanding of a person ordinarily skilled in the art to which the present disclosure pertains, may be deemed to merely describe certain embodiments, and are not intended to limit the present disclosure.

In the present specification, any singular expressions shall be deemed to include plural forms, unless otherwise described. When a component is described to "include" or "comprise" an element, it shall mean that the component may further include another element. Moreover, when it is described to be "on" an element, it shall be appreciated to be above or below said element, and not necessarily above said element in a gravitational direction.

When an element is described to be "connected" or "coupled" to another element, it shall include not only the case of said element directly being connected or coupled to the other element but also the case of said element indirectly being connected or coupled to the other element by way of yet another element. While terms such as "first" and "second" may be used to describe an element, these terms are used solely for the purpose of distinguishing one element from another element and are not intended to define, for example, the nature, order, or sequence of the elements.

Figure 1:
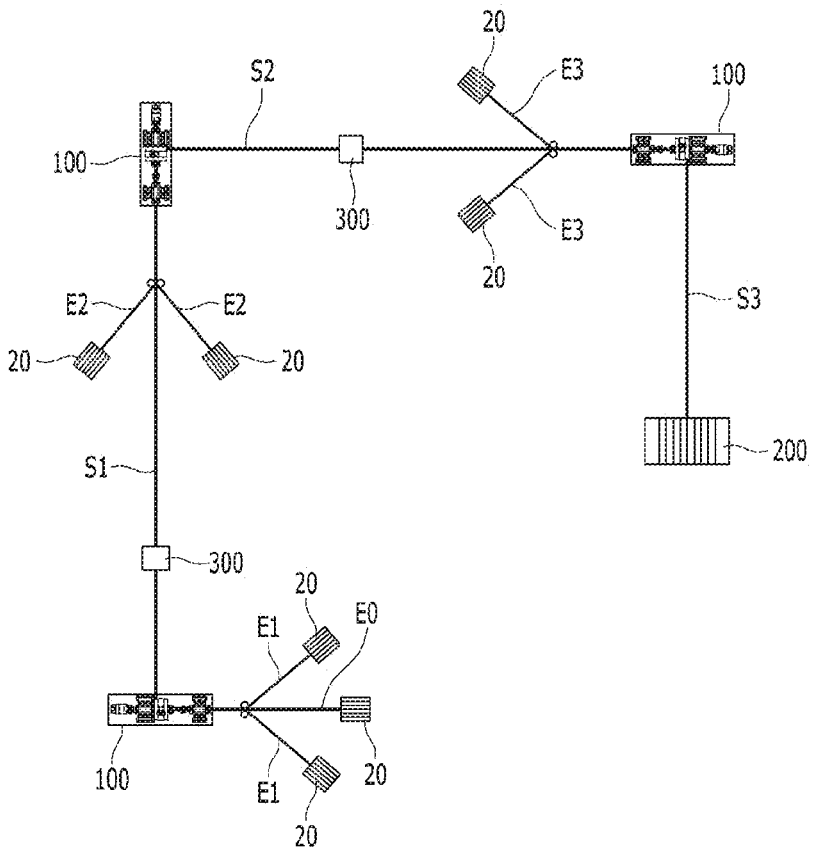
FIG. 1 is a schematic view of a continuous stranding system according to an embodiment of the present disclosure.
Figure 2:
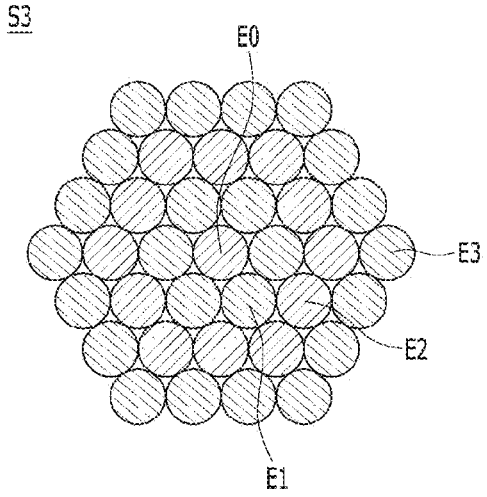
FIG. 2 is a cross-sectional view of a strand manufactured by the continuous stranding system shown in FIG. 1.

FIG. 1 is a schematic view of a continuous stranding system according to an embodiment of the present disclosure, and FIG. 2 is a cross-sectional view of a strand manufactured by the continuous stranding system shown in FIG. 1.

Referring to FIGS. 1 and 2, the continuous stranding system 10 according to an embodiment of the present disclosure may include a plurality of stranders 100 and a winding spool 200 and further include a tension control device 300.

Each of the plurality of stranders 100 may be configured to receive a center wire and a plurality of peripheral wires from outside of the corresponding strander 100, manufacture a strand in a shape of the plurality of peripheral wires stranded to a layer around the center wire, and discharge the manufactured strand to outside of the corresponding strander 100.

Particularly, a strander 100 first disposed among the plurality of stranders 100 may be configured to receive a center wire and a plurality of peripheral wires from the supply spool 20 of a plurality of wires as shown in the figure.

As a result, the first disposed strander 100 may be configured to manufacture a strand S1 with the plurality, e.g. 6, of peripheral wires E1 stranded to one layer around the center wire E0.

Meanwhile, the rest stranders 100 among the plurality of stranders 100 may be configured to receive a strand discharged from a preceding strander 100 as a center wire and a wire from the supply spool 20 of a plurality of wires as a plurality of peripheral wires.

As a result, a second disposed strander 100 may be configured to manufacture a strand S2 with a plurality, e.g. 12, of peripheral wires E2 stranded to one layer around the strand S1 discharged from the first disposed strander 100. A third disposed strander 100 may be configured to manufacture a strand S3 with a plurality, e.g. 18, of peripheral wires E3 stranded to one layer around the strand S2 discharged from the second disposed strander 100.

In an embodiment of the present disclosure, only three stranders 100 are illustrated. However, the present disclosure is not limited to what is illustrated in the figures, and the number of stranders 100 may be 4, 5 or more.

The winding spool 200 may be configured to wind the strand S3 manufactured in the shape of the plurality of peripheral wires E1, E2 and E3 stranded to multiple layers around the center wire E0 through the plurality of stranders 100.

The winding spool 200 may include a winding drum configured to wind the strand S3 and a fourth motor configured to rotate the winding drum.

The tension control device 300 may be interposed among the plurality of stranders 100, respectively, and configured to control a tension of a strand to be provided to a subsequent strander 100 to a level required for the subsequent strander 100.

In addition, a calibrator (not shown) may be interposed among the plurality of stranders 100 or between a last disposed strander 100 among the plurality of stranders 100 and a winding spool 200, respectively. The calibrator, a device, such as an oval twister, commonly known in the corresponding technical field, may be configured to calibrate twisting of a stranded strand in a strander 100 or adjust a wiring pitch. Therefore, a detailed description thereof is omitted.

Figure 3:
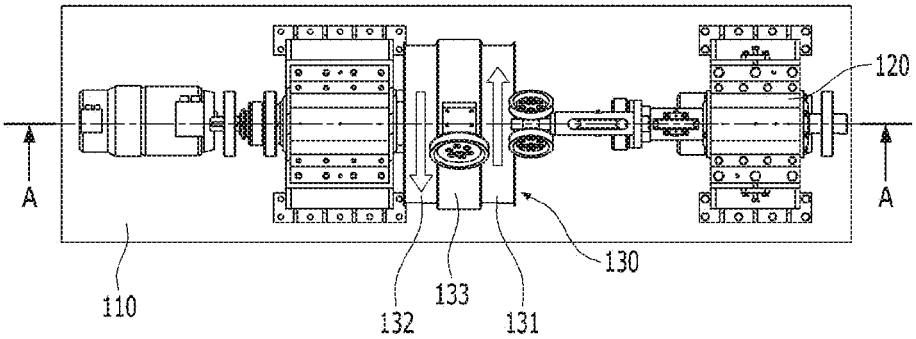
FIG. 3 is a magnified view of a strander among the plurality of stranders shown in FIG. 1.
Figure 4:
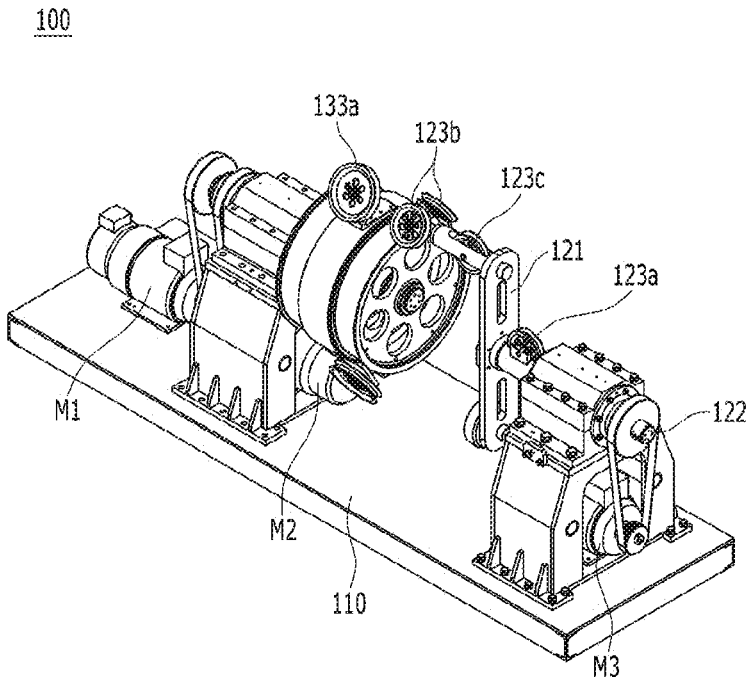
FIGS. 4 and 5 are perspective views of FIG. 3.
Figure 5:
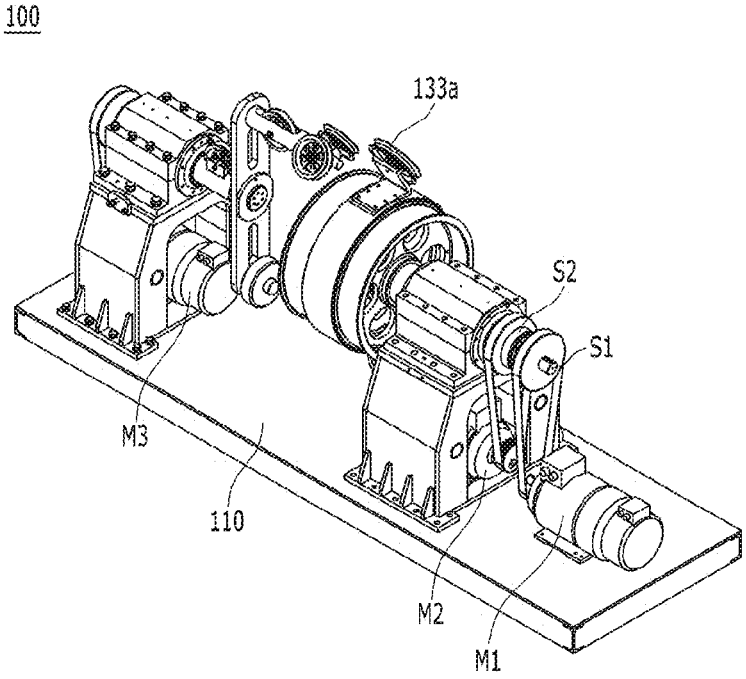
Figure 6:
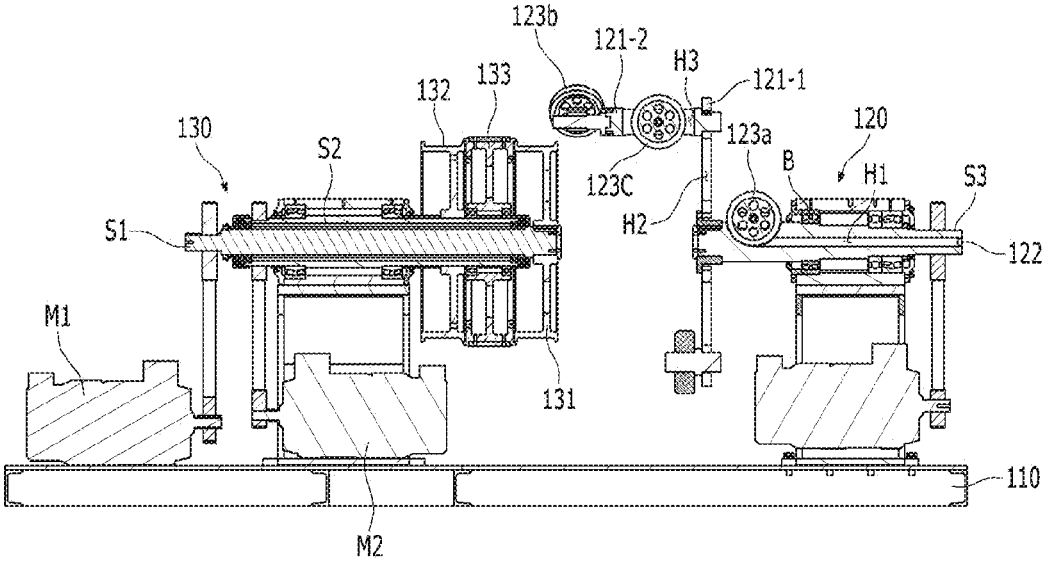
FIG. 6 is a cross-sectional view of FIG. 3 taken along the A-A line.
Figure 7:
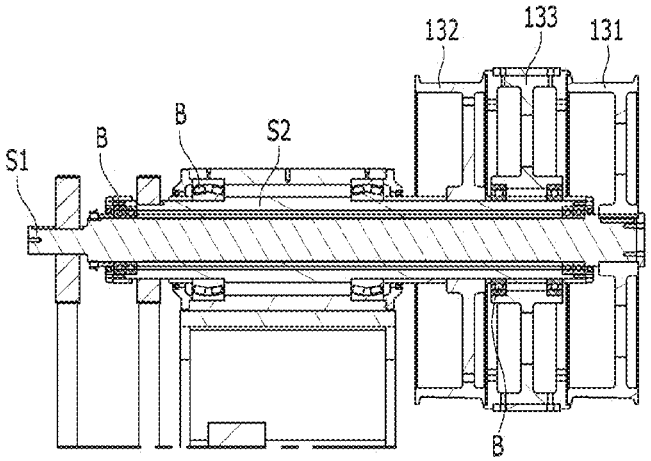
FIG. 7 is a cross-sectional view of a magnified portion of FIG. 6.

FIG. 3 is a magnified view of a strander among the plurality of stranders shown in FIG. 1, FIGS. 4 and 5 are perspective views of FIG. 3. FIG. 6 a cross-sectional view of FIG. 3 taken along the A-A line, and FIG. 7 is a cross-sectional view of a magnified portion of FIG. 6.

Referring to FIGS. 3 through 7, the strander 100 may include a stranding unit 120 and a capstan unit 130. A base frame 110 may be further included to modularize the strander 100.

The base frame 110 may be provided with or coupled to the stranding unit 120 and the capstan unit 130.

Accordingly, the respective strander 100 may have it components coupled to each other through the base frame 110 for modularization.

The stranding unit 120 may be configured to strand a center wire and a plurality of peripheral wires provided from outside by rotation to manufacture a strand.

Here, the center wire may be a wire E0 provided from the wire supply spool 20 or a strand S1 and S2 provided from a preceding strander 100 as described about FIGS. 1 and 2, and the peripheral wire may be a wire E1, E2 and E3 provided from the wire supply spool 20.

A detailed description of a specific structure and an operation principle of the stranding unit 120 is described later.

The capstan unit 130 may be configured to pull a strand that is stranded and discharged by the stranding unit 120 so that the center wire and the plurality of peripheral wires provided from outside of the strander 100 may pass through the stranding unit 120.

That is, the center wire and the plurality of peripheral wires provided from outside of the strander 100 may pass through the stranding unit 120 by the capstan unit 130 that pulls the strand and be stranded to a strand by a rotational force provided by the stranding unit 120 during the process of passing through the stranding unit 120.

The capstan unit 130 may include a capstan drum 131, an unwinding drum 132 and a turn drum 133.

The capstan drum 131 may be coupled to a first rotational shaft S1, which is rotated by a first motor M1.

Accordingly, the capstan drum 131 may be configured to be rotated by a rotational force provided by the first motor M1 to wind a strand that has passed the stranding unit 120.

The unwinding drum 132 may be disposed apart from the capstan drum 131 in a length direction of the first rotational shaft S1.

In the unwinding drum 132, a strand unwound from the capstan drum 131 may be wound in an opposite direction of a winding direction in the capstan drum 131, and a strand wound on the unwinding drum 132 may be discharged to a stranding unit or a winding spool 200 of a subsequent strander 100 that is disposed after the corresponding strander 100 by a rotational force of a capstan drum or a winding spool 200 of the subsequent strander 100.

The unwinding drum 132 and the second rotational shaft S2 coupled thereto may be configured to rotate in an opposite direction of the first rotational shaft S1 and the capstan drum 131 coupled thereto as indicated by the arrow in FIG. 3.

The unwinding drum 132 may be rotated by the force of the capstan drum or the winding spool 200 of the subsequent strander 100 pulling a strand wound on the unwinding drum 132. However, the present disclosure is not limited to the above configuration, the second rotational shaft S2 may be rotated by the second motor M2.

As a result, the unwinding drum 132 may be configured to function as an accumulator along with the capstan drum 131 as the unwinding drum 132 is rotated by a rotational force provided by the second motor M2 to discharge and wind a strand wound on the capstan drum 131 when there is no force from the capstan drum or the winding spool 200 of the subsequent strander 100 pulling a strand wound on the unwinding drum 132, e.g. when the winding spool 200 is being replaced.

In addition, the second rotational shaft S2 may be formed in a hollow cylindrical shape so that the first rotational shaft is disposed to penetrate the second rotational shaft in a length direction of the second rotational shaft. As a result, it is possible not only to configure a more compact configuration of the capstan unit 130 but also to prevent a possibility of interference between the stranding unit 120 and a power transfer unit of the second motor M2, e.g. a belt, during the rotation operation of the stranding unit 120.

Meanwhile, the first rotational shaft S1 may be rotatably supported by a bearing B interposed between the first rotational shaft S1 and the second rotational shaft S2, and the second rotational shaft S2 may be rotatably supported by a bearing B interposed between the base frame 110 and the second rotational shaft S2.

The turn drum 133 may be interposed between the capstan drum 131 and the unwinding drum 132 and provided with the first guide roller 133*a* configured to guide a strand unwound from the capstan drum 131 to the unwinding drum 132.

Particularly, the first guide roller 133*a* may be rotatably coupled to a bracket coupled to the perimeter surface of the turn drum 133 and configured to guide a strand unwound from the capstan drum 131 to be wound on the unwinding drum 132 in an opposite direction of a winding direction of the capstan drum 131.

In addition, the turn drum 133 may be supported to freely rotate in either direction by a bearing interposed between the turn drum 133 and the second rotational shaft S2

As a result, when a rotational speed of the capstan drum 131 is different from that of the unwinding drum 132, the turn drum 133 may be configured to rotate either in the same direction as a rotation direction of the capstan drum 131 or in the same direction as a rotation direction of the unwinding drum 132. Accordingly, it is possible to control the rotational speed of the capstan drum 131 and the rotational speed of the unwinding drum 132 differently.

For an example, when the rotational speed of the unwinding drum 132 is higher than the rotational speed of the capstan drum 131, the turn drum 133 may rotate in the same direction as the rotational direction of the unwinding drum 132.

For another example, when the rotational speed of the unwinding drum 132 is lower than the rotational speed of the capstan drum 131, the turn drum 133 may rotate in the same direction as the rotational direction of the capstan drum 131.

The stranding unit 120 may include a rotor 121, a poise 122 and a plurality of second guide rollers 123*a*, 123*b* and 123*c*.

The rotor 121 may include a third rotational shaft S3, a first arm 121-1, and a second arm 122-2.

The third rotational shaft S3 may be rotatably supported by a bearing B interposed between the base frame 110 and the third rotational shaft S3 and configured to be rotated by the third motor M3.

The first arm 121-1 may extend from an end of the third rotational shaft S3 towards a radius direction of the third rotational shaft S3.

The second arm 121-2 may horizontally extend from an end of the first arm 121-1 on a perimeter surface of the capstan drum 131.

In addition, another end of the third rotational shaft S3 may be formed with a first penetrating hole H1, and the poise 122 may be coupled to the other end of the third rotational shaft S3.

The poise 122 may be configured to strand the center wire and the plurality of peripheral wires provided from outside of the strander 100 to a strand by rotation of the rotor 121 and discharge the strand through the first penetrating hole H1.

The poise 122 may be referred, for example, as a wire collection equipment and a commonly known device in the corresponding technical field. Therefore, a detailed description thereof is omitted.

The plurality of the second guide rollers 123*a*, 123*b* and 123*c* may be respectively and rotatably coupled to a rotor 121 and configured to guide a strand discharged from the poise 122 through the first penetrating hole H1 to the capstan drum 131 so that the strand may be wound on the capstan drum 131.

Specifically, an outlet of the first penetrating hole H1 may be formed on a perimeter surface of the third rotational shaft that is not a length direction end of the third rotational shaft S3, and the plurality of a second guide rollers 123*a*, 123*b* and 123 may include a 2-1 guide roller 123*a*, a 2-2 guide roller 123*b* and a 2-3 guide roller 123*c*. The 2-1 guide roller 123*a* may be rotatably coupled to the third rotational shaft S3 and configured to guide a strand to be discharged through an outlet of the first penetrating hole H1. The 2-2 guide roller 123*b* may be rotatably coupled to an end of the second arm 121-2 and configured to guide a strand to the capstan drum 131. The 2-3 guide roller 123*c* may be rotatably coupled to the second arm 121-2 and configured to guide a strand from the 2-1 guide roller 123*a* to the 2-2 guide roller 123*b* sequentially through a second penetrating hole H2 formed on the first arm 121-1 and a third penetrating hole H3 formed on the second arm 121-2. For example, the 2-3 guide roller 123*c* may be disposed inside the third penetrating hole H3. As a result, it may be possible to configure a more compact configuration of the stranding unit 120.

Meanwhile, the third rotational shaft S3 may be disposed to extend in a length direction of the first rotational shaft S1.

Figure 8:
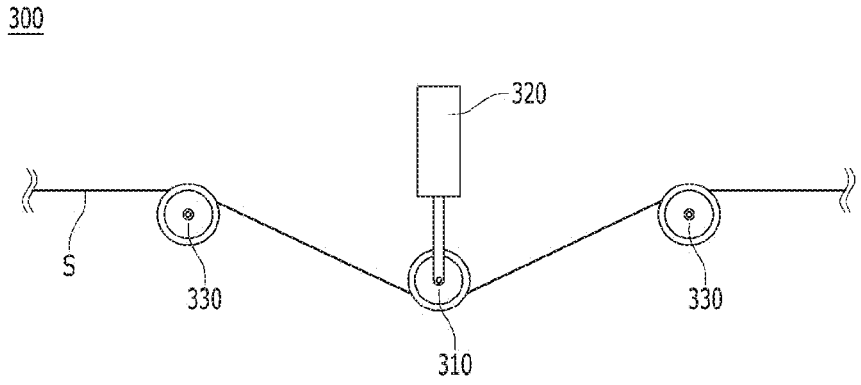
FIG. 8 is an illustration of an exemplary configuration of the tension control device shown in FIG. 1.

FIG. 8 is an illustration of an exemplary configuration of the tension control device shown in FIG. 1.

Referring to FIGS. 1 and 8, the tension control device 300 may be interposed among the plurality of stranders 100 and configured to control a tension of strand S discharged from a preceding strander 100 to be provided to a subsequent strander 100.

For example, the tension control device 300 may include a pressure roller 310 disposed to make contact with the strand S and a pneumatic cylinder 320 configured to move the pressure roller 310 towards or away from the strand S. However, the present disclosure is not limited to this configuration, and the tension control device 300 may be replaced with another tension control device, such as a spring or a dancer, commonly known in the technical field.

In addition, the tension control device 300 may further include a pair of third guide rollers 330 detachedly disposed with the pressure roller 310 therebetween and configured to guide the strand S.

Meanwhile, according to an embodiment of the present disclosure, as a supply direction of a center wire and a discharge direction of a strand of each strander 100 may be set to be perpendicular to each other on the horizontal surface, the plurality of stranders 100 and the winding spool 200 may be disposed in a clockwise or a counterclockwise direction as shown in FIG. 1. Accordingly, in comparison to when the plurality of stranders is aligned in a row, there is an advantage in obtaining the better space utilization and the less restricted installation space.

While the foregoing describes certain preferred embodiments of the present disclosure, these are merely examples, and it shall be appreciated that the disclosed embodiments are not intended to restrict the present disclosure thereto. Anyone ordinarily skilled in the art to which the present disclosure pertains shall appreciate that there may be a variety of modifications and permutations of an embodiment of the present disclosure without departing from the technical ideas and scopes of the present disclosure that are defined in the appended claims by supplementing, modifying, omitting, or adding an element and such modifications or permutations are also included in the scope of the present disclosure.

What is claimed is:

1. A continuous stranding system comprising:

a plurality of stranders in series, each strander in the series of plurality of stranders is configured to receive a center wire and a plurality of peripheral wires, each of the center wire and the plurality of peripheral wires is provided externally from each of the plurality of stranders, wherein each strander in the series of plurality of stranders is structured to manufacture and discharge a strand in a shape of the plurality of peripheral wires received by each strander stranded to a single layer around the center wire, wherein the center wire received by a subsequent strander in the series of plurality of stranders comprises the strand discharged from a prior strander in the series of plurality of stranders;

a winding spool configured to wind the strand from a terminal strander in the series of plurality of stranders; and wherein each strander in the series of plurality of stranders comprises:

a stranding unit configured to strand the center wire and the plurality of peripheral wires received by each strander by rotation; and a capstan unit configured to pull the strand stranded by and discharged from the stranding unit so that the center wire and the plurality of peripheral wires received by each strander pass through the stranding unit, wherein the capstan unit comprises:

a capstan drum coupled to a first rotational shaft rotatable by a first motor and configured to wind a strand;

an unwinding drum detachably disposed from the capstan drum in a length direction of the first rotational shaft; and a turn drum interposed between the capstan drum and the unwinding drum and provided with a first guide roller configured to guide the strand, which is wound and unwound from the capstan drum, to be wound on the unwinding drum in an opposite direction to a winding direction of the capstan drum, wherein the strand wound on the unwinding drum is unwound from the unwinding drum and discharged to the subsequent strander in the series of plurality of stranders or the winding spool by a rotational force of a capstan drum of the subsequent strander in the series of plurality of stranders or the winding spool.

2. The continuous stranding system of claim 1, further comprising a tension control device interposed between each prior strander and each subsequent strander in the series of plurality of stranders.

3. The continuous stranding system of claim 1, wherein each strander in the series of plurality of stranders further comprises a base frame for mounting the stranding unit and the capstan unit of each strander.

4. The continuous stranding system of claim 1, wherein the unwinding drum of the capstan unit of each strander in the series of plurality of stranders is coupled to a second rotational shaft configured to rotate in an opposite direction of the first rotational shaft by a second motor to unwind the strand wound on the capstan drum and then wind the strand on the unwinding drum.

5. The continuous stranding system of claim 4, wherein the turn drum of the capstan unit of each strander in the series of plurality of stranders is supported to freely rotate in either direction by a bearing interposed between the turn drum and the first rotational shaft or the second rotational shaft.

6. The continuous stranding system of claim 4, wherein the second rotational shaft has a hollow cylindrical shape so that the first rotational shaft is disposed to penetrate the second rotational shaft in a length direction of the second rotational shaft.

7. The continuous stranding system of claim 1, wherein the stranding unit of each strander in the series of plurality of stranders comprises:

a rotator comprising a third rotational shaft rotatable by a third motor, a first arm extended from an end of the third rotational shaft in a radius direction and a second arm horizontally extended from an end of the first arm toward a perimeter surface of the capstan drum and provided with a first penetrating hole at another end of the third rotational shaft;

a poise coupled to the other end of the third rotational shaft and configured to strand the center wire and the plurality of peripheral wires received by each strander by rotation of the rotator and discharge the strand through the first penetrating hole; and a plurality of second guide rollers rotatably coupled to the rotator and configured to guide the strand discharged through the first penetrating hole to be wound on the capstan drum.

8. The continuous stranding system of claim 7, wherein the third rotational shaft extends in a length direction of the first rotational shaft.

9. The continuous stranding system of claim 7, wherein an outlet of the first penetrating hole is formed on a perimeter surface of the third rotational shaft that is not an end, and wherein the plurality of the second guide rollers comprise:

a 2-1 guide roller rotatably coupled to the third rotational shaft and configured to guide the strand to be discharged through the outlet;

a 2-2 guide roller rotatably coupled to an end of the second arm and configured to guide a strand to the capstan drum; and a 2-3 guide roller rotatably coupled to the second arm and configured to guide a strand from the 2-1 guide roller to the 2-2 guide roller sequentially through a second penetrating hole formed on the first arm and a third penetrating hole formed on the second arm.

* * * * *